United States Patent [19]

Boland et al.

[11] Patent Number: 4,526,136

[45] Date of Patent: Jul. 2, 1985

[54] CONTROL SYSTEM FOR FLUID HEATED STEAM GENERATOR

[75] Inventors: James F. Boland, Bonneville County; John F. Koenig, Idaho Falls, both of Id.

[73] Assignee: The United States of America as represented by the United States Department of Energy, Washington, D.C.

[21] Appl. No.: 614,507

[22] Filed: May 29, 1984

[51] Int. Cl.[3] ..... F22D 5/26

[52] U.S. Cl. ..... 122/451.1; 122/451 S

[58] Field of Search ..... 122/451 S, 451.1, 451.2

[56] References Cited

U.S. PATENT DOCUMENTS

| | | | |
|---|---|---|---|
| 2,800,887 | 7/1957 | Profos | 122/451.1 X |
| 3,004,529 | 10/1961 | Argersinger et al. | 122/451.1 X |
| 3,029,197 | 8/1962 | Untermyer . | |
| 3,126,053 | 3/1964 | Brunner | 122/451.1 X |
| 3,275,524 | 9/1966 | Williams . | |
| 3,287,229 | 11/1966 | Peters . | |
| 3,296,083 | 1/1967 | Haake et al. . | |
| 3,561,406 | 2/1971 | Rupprecht . | |

*Primary Examiner*—Edward G. Favors

*Attorney, Agent, or Firm*—Jeannette M. Walder; Paul A. Gottlieb; Judson R. Hightower

[57] ABSTRACT

A control system for controlling the location of the nucleate-boiling region in a fluid heated steam generator comprises means for measuring the temperature gradient (change in temperature per unit length) of the heating fluid along the steam generator; means for determining a control variable in accordance with a predetermined function of temperature gradients and for generating a control signal in response thereto; and means for adjusting the feedwater flow rate in accordance with the control signal.

10 Claims, 2 Drawing Figures

STEAM GENERATOR TEMPERATURE PROFILE

CONTROL SYSTEM FOR FLUID HEATED STEAM GENERATOR

CONTRACTUAL ORIGIN OF THE INVENTION

The U.S. Government has rights in this invention pursuant to Contract No. W-31-109-ENG-38 between the U.S. Department of Energy and the University of Chicago representing Argonne National Laboratory.

BACKGROUND OF THE INVENTION

This invention relates generally to a control system for a fluid heated steam generator of the once-through or low-recirculation-rate type. The invention is of particular significance to steam generators that are heated by the thermal output of nuclear reactors where, for example, a liquid metal is the heating fluid.

The different heat transfer regions that may be present within a steam generator are normally identified by the terms "sub-cooled", "nucleate boiling", "film-boiling", and "superheat". The "sub-cooled" region is that region in which the water is below the saturation temperature at the pressure extent within the tube and the heat-transfer rate is somewhat less than in the "nucleate-boiling" region. The "nucleate-boiling" region is that region in which ebullition takes place at a solid-liquid interface and the tube inner-surface temperature approaches the water saturation temperature. The "film-boiling" region is that region in which a film of superheated steam forms over part or all of the heating surface and the heat-transfer rate is greatly reduced compared to that in the "nucleate-boiling" region. The "superheat" region is that region in which the steam quality is 100% and the bulk steam temperature is above the saturation temperature. When the location of the nucleate-boiling region is uncontrolled, it shifts back and forth along the length of the steam generator. This is extremely undesirable as the generator tubes are subject to repeated thermal cycling causing creep-fatigue damage.

Control of once-through or low-recirculation-rate liquid-metal-heated steam generators has been accomplished by processes that use measurements of water-side parameters such as steam flow, steam temperature, feedwater flow, and feedwater temperature, as well as various heat-balance calculations. These control systems are capable of maintaining the outlet steam pressure and temperature within reasonable bounds, while preventing gross instability in the nucleate boiling region within the steam generator. However, these control systems provided little or no control over the location of the nucleate boiling region within the steam generator. Furthermore, they have limited ability to control the location of the nucleate boiling region during changes in load or upsets in the heating-fluid or water systems. Direct measurement of tube wall temperatures is impracticable in commercial units because of the difficulty in maintaining temperature sensors and the large number of measurements that would be required to obtain a sample representative of the average temperature of the tubes at specific elevation. Concern for controllability and stability of the location of the nucleate-boiling region in liquid-metal heated steam generators of the once-through type has caused some plant designers to choose less efficient systems containing natural-circulation evaporators, steam drums, and separate superheaters.

Therefore, it is an object of the present invention to provide a control system for fluid heated steam generators.

It is another object of the present invention to provide a method of controlling the location of the nucleate-boiling region within a fluid heated steam generator.

Additional objects, advantages, and novel features of the invention will be set forth in part in the description which follows, and in part will become apparent to those skilled in the art upon examination of the following or may be learned by practice of the invention.

SUMMARY OF THE INVENTION

This invention provides a system and method for controlling the location of the nucleate-boiling region in fluid heated steam generators that are designed to have a nucleate boiling region and a sub-cooled or film boiling region within continuous tubes within the shell of the steam generator in which the heating fluid flows. It also provides a method for measuring the location of the nucleate-boiling region within such a steam generator that provides input to the control system and without which the control system could not function.

The location of the nucleate-boiling region is determined by measuring the difference in the rate of change of the heating fluid temperature as a function of heat exchanger length that occurs when heat transfer within the tube changes from the nucleate boiling to the film boiling process. Control is accomplished by adjusting the feedwater flow rate to force this change to occur within a desired region along the length of the tube. The feedwater flow rate is adjusted in order to keep the tube temperature reasonably constant at any given point along its length for all operating conditions within its normal load range in order to limit creep-fatigue damage to the tubes. The essential feature of this invention is the use of the observed change in slope of the heating fluid temperature profile to adjust the feedwater flow rate to force the rapid change in wall temperature to occur over about the same region of tube length.

In accordance with the foregoing a system for controlling the location of the nucleate boiling region in a fluid heated steam generator may comprise: means for measuring the temperature gradient (change in temperature per unit length) of the heating fluid at a plurality of locations along the steam generator; means for determining a control variable, $Q_w$, in accordance with a predetermined relationship, said relationship being a function of said measured temperature gradients, and for generating a control signal in response thereto; and means for adjusting $Q_{FW}$, the feedwater flow rate into the steam generator, in accordance with said control signal. Although this invention will be described hereafter in reference to a liquid sodium-to-water heat exchanger, the control system and method are applicable for any fluid-to-water heat exchanger in which the heat transfer rate is primarily limited by the film coefficient on the water side of the exchanger.

BRIEF DESCRIPTION OF THE DRAWINGS

The present invention is illustrated in the accompanying drawings wherein.

DETAILED DESCRIPTION OF THE INVENTION

Figure 1:
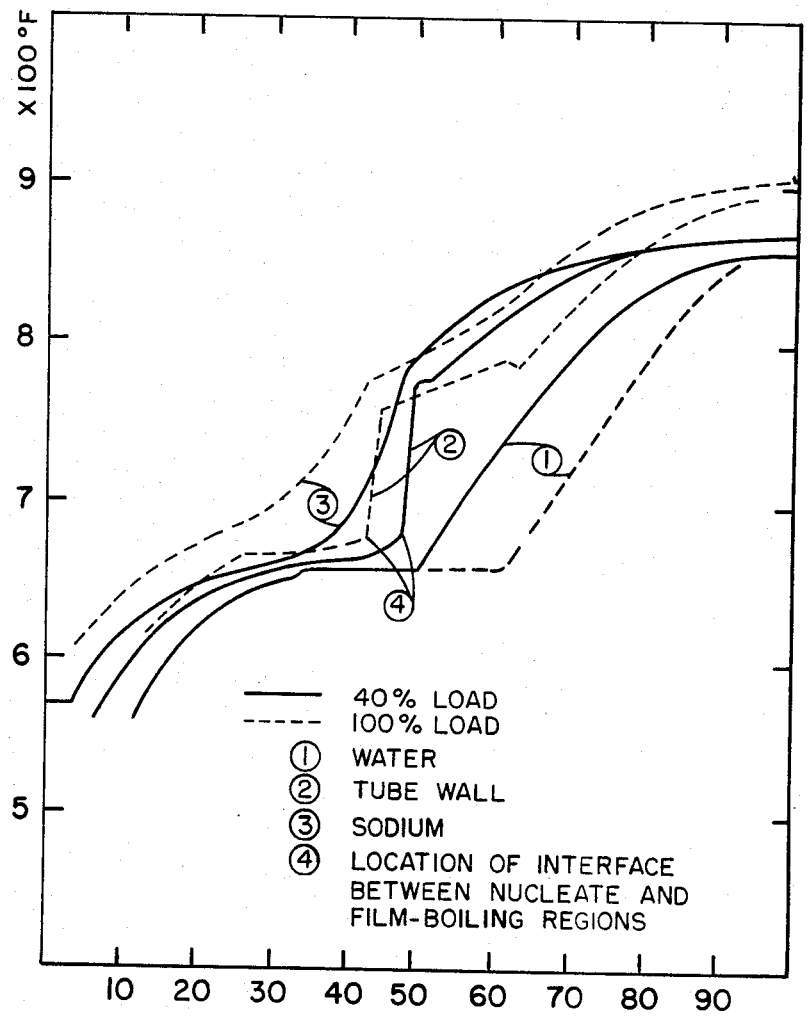
FIG. 1 shows sodium, water, and inside tube temperature profiles (temperature vs. tube length) for a steam generator operating at loads of 40% and 100% of rated power.

Referring to FIG. 1, calculations of the temperature profiles (temperature shown as a function of heat exchanger tube length) were made assuming that the steam outlet temperature and pressure, and the sodium temperature change across the heat exchanger remain constant under the two loading conditions: 40% and 100% of rated power. From the temperature profiles, it can be seen that the steep rise in tube wall temperature occurs at about 45% of tube length, which corresponds to the location of the interface between the nucleate-boiling and film-boiling regions (4). Note that the sodium curve (3) changes at about the same point under both loading conditions, but that the water temperature (1) remains constant at this point. Calculations for a number of operating conditions (not shown on FIG. 1) have shown that a sharp change in the sodium temperature profile always occurs at the interface between the nucleate and film boiling regions.

Figure 2:
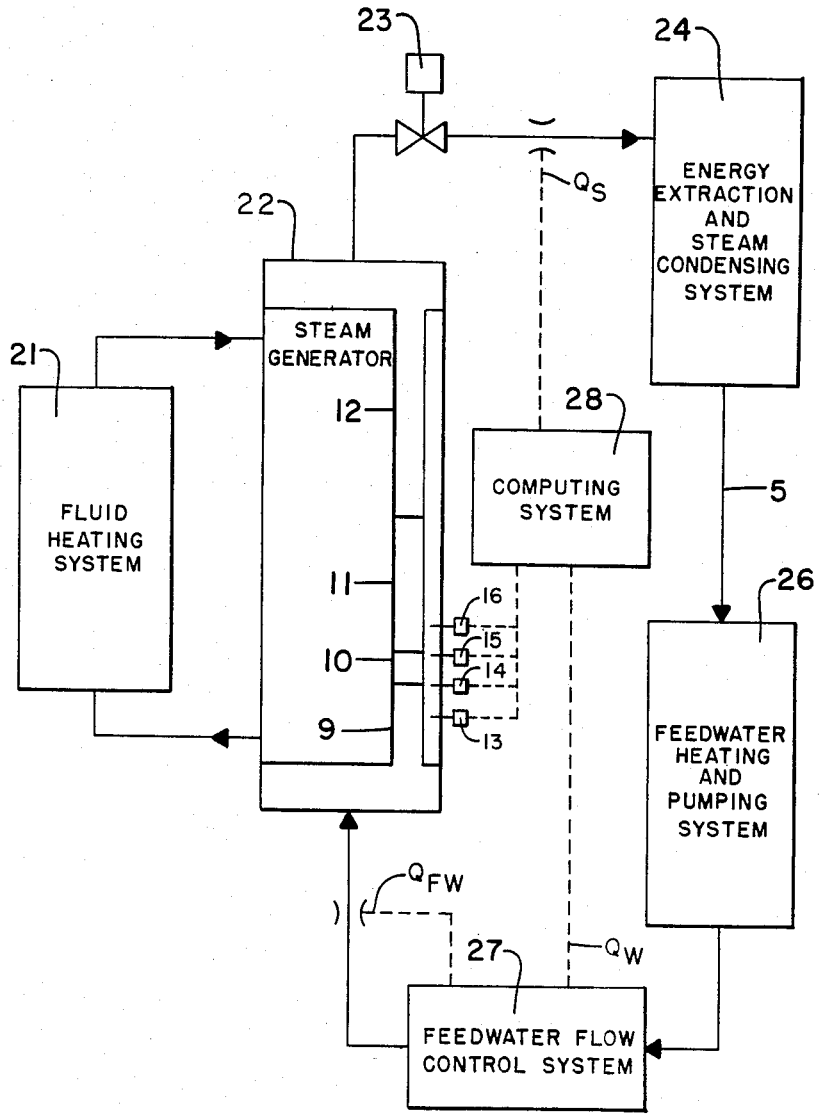
FIG. 2 is a schematic representation of a steam generator using the control system of the present invention.

Referring to FIG. 2, fluid heating system 21 provides liquid sodium at a known and controlled flow rate and temperature to the heating side of steam generator 22, where heat is extracted and the cooled sodium is returned to the heating system. Superheated steam from the water side of steam generator 22 is supplied through pressure control valve 23 to energy extraction and steam condensing system 24. Condensate 5 from steam condensing system 24 is supplied to feedwater heating and pumping system 26 and then to feedwater flow control system 27.

Steam generator 22 has the following heat transfer regions: subcooled 9, nucleate boiling 10, film-boiling 11, and superheating 12. Temperature sensors (thermocouples) are attached to the shell or placed in immersion wells on the liquid sodium side. Thermocouples 13, 14, 15, 16 are placed in the subcooled (13) and film-boiling (16) regions, near the interface between the sub-cooled and nucleate-boiling regions (14), and near the interface between the nucleate-boiling and film-boiling regions (15). The distances between 13 and 14 and between 15 and 16 are made equal so that the ratio of temperature gradients can be obtained by subtracting temperatures as shown in equations 1 and 2 infra. If these distances were unequal, appropriate changes would be required in equations 1 and 2. Computing system 28 uses the measured temperatures and measured steam flow rate $Q_s$ to determine a control variable and to generate a control signal $Q_w$. Feedwater flow control system 27 controls the feedwater flow rate $Q_{FW}$ into the steam generator in accordance with the control signal $Q_W$.

Computing system 28 determines the control signal from a predetermined relationship, which is a function of sodium temperature gradient. A general relationship suitable for use in a steam generator control system is given by equation 1:

$$Q_w = Q_s(K_1 + K_2A) + K_3B + K_4\int Cdt + K_5dD/dt \quad (1)$$

wherein: $K_1$, $K_2$, $K_3$, $K_4$, and $K_5$ may be constants or variables dependent on measured or predicted characteristics of the steam generator; A, B, C, and D are terms containing functions of the heating fluid temperature gradients measured in two regions of the steam generator having different heat transfer characteristics; $Q_w$ is the feedwater flow, or a function capable of causing changes in feedwater flow; and $Q_s$ is the measured exit steam flow.

A more useful and preferable relationship is given by equation 2:

$$Q_w = Q_s\{K_1 + K_2[(T_4 - T_3)/(T_2 - T_1) - K_3]\} \quad (2)$$

wherein: $Q_w$ is the feedwater flow demand; $Q_s$ is the measured steam flow; $K_1$ is a constant, $K_2$ is a constant, $K_3$ is a constant equal to the desired value of the ratio $(T_4-T_3)/(T_2-T_1)$; and $T_1$, $T_2$, $T_3$, and $T_4$ are measured temperatures at the locations shown in FIG. 2.

A computer simulation of a control system for controlling the location of the nucleate boiling region in a steam generator in accordance with the system shown in FIG. 2 and the design parameters from Table I, using equation 2 to determine the control variable was performed. Table II shows the simulation data obtained. The computer simulation was modeled using the Dynamic Simulator For Nuclear Power Plants (DSNP), as described in ANL-CT-77-20, Argonne National Laboratory (1978). The steam generator model used in DSNP for these simulations is described in Paper 83-WA/HT-19 by G. Berry, Argonne National Laboratory, presented at the 1983 Winter Annual Meeting of The American Society of Mechanical Engineers.

TABLE I

| DESIGN PARAMETERS | |
|---|---|
| Steam generator power | 875 MW |
| Operating pressure | 172 MPa |
| Tube length | 23.5 m |
| Steam outlet temperature | 490 C |
| Feedwater temperature | 196 C |
| Sodium inlet temperature | 507 C |
| Sodium outlet temperature | 334 C |
| Load range | 40–100% |
| Load rate of change for 10% change | 1.0%/s |
| Load rate of change for 40% to 100% load | 0.1%/s |
| Sub-cooled length | 4.8 m |
| Nucleate-boiling length | 0.95 m |
| Film-boiling length | 8.8 m |

TABLE II

SIMULATION DATA

| Parameter | Initial | Case-1 | Case-2 | Case-3 |
|---|---|---|---|---|
| Steam generator power, (%) | 100 | 83 | 83 | 45 |
| Steam temperature, (C.) | 489 | 494 | 493 | 504 |
| Feedwater flow, (%) | 100 | 83 | 84 | 45 |
| Feedwater temperature, (C.) | 196 | 196 | 196 | 196 |
| Sodium inlet temperature, (C.) | 507 | 507 | 507 | 507 |
| Sodium outlet temperature, (C.) | 334 | 327 | 326 | 311 |
| Sodium flow, (%) | 100 | 80 | 80 | 40 |
| Rate-of-change of sodium flow, (%/s) | | 1.0 | 1.0 | 1.0 |
| Value of $K_1$ | 1.0 | 0.95 | 1.05 | 1.0 |
| Value of $K_2$ | 0.50 | 0.50 | 0.50 | 0.50 |
| Value of $K_3$ | 0.55 | 0.55 | 0.55 | 0.55 |
| Elevation of NB exit at steady state, (m) | 5.81 | 5.75 | 5.88 | 5.68 |
| Max. el. of NB exit during transient, (m) | | 5.83 | 5.93 | 5.87 |
| Min. el. of NB exit during transient, (m) | | 5.72 | 5.87 | 5.34 |

As can be seen from the data in Table II, the Case-1 simulation demonstrated for a −5% error in steam flow measurement and a reduction in sodium flow of 20%, at a rate of 1%/s, the practice of this invention results in excellent control of the location of the nucleate-boiling region. The Case-2 simulation provides a similar demonstration for a condition of +5% error in steam flow measurement. A positive or a negative error of 5% bounds the design error limits for steam-flow or feedwater-flow for the example system. Design specifications for the example steam generator are to accommodate a 10% change in load at a 1%/s rate and the Case-1 and Case-2 simulations demonstrate that the practice of this invention provides satisfactory control under combined transients in the feedwater and sodium systems that exceed the small-load-change specifications.

As can be seen from the data in Table II, the Case-3 simulation demonstrated that the practice of this invention results in satisfactory control of the location of the nucleate-boiling region within the steam generator for a large load change at a rate ten times as fast as that specified for the example system.

The embodiment described in this example is not necessarily the preferred embodiment for steam generators of all designs or all design load ranges, but the steam generator design used in the example has a very short nucleate-boiling region located between comparatively long subcooled and film-boiling regions, and therefore, lends itself to the simple embodiment described for this example.

The algorithm of Equation 2 provides a "proportional-type" control in which an error in a variable exists at equilibrium conditions. In the example, a small downward movement of the nucleate-boiling region causes the temperature $T_2$ to increase, while the temperature gradient between $T_3$ and $T_4$ remains about constant, and temperature $T_1$ also remains about constant. Thus the ratio $(T_4-T_3)/(T_2-T_1)$ decreases below the value obtained at the reference conditions. In the example, a small upward movement of the nucleate-boiling region causes the temperature $T_3$ to decrease, while the temperature gradient between $T_1$ and $T_2$ remains about constant, and temperature $T_4$ also remains about constant. Thus the ratio $(T_4-T_3)/(T_2-T_1)$ increases above the value obtained at the reference conditions. For the post-transient Case-1 conditions, the level change of the exit from the nucleate boiling region was −0.07 m from that at the 100% power conditions. For the post-transient Case-2 conditions, the level change of the exit from the nucleate boiling region was +0.06 m from that at the 100% power condition. The magnitude of the steady-state level error can be adjusted by changing the value of $K_2$, but too high a value can cause the system to be unstable. Normal control system practice is to adjust the value of $K_2$ after the system is in operation to obtain a minimum level error with acceptable system stability.

The above description of this invention is given by way of example only and it should be understood that numerous modifications can be made therein without departing from the scope of the invention as claimed in the following claims.

The embodiments of this invention in which an exclusive property or privilge is claimed are defined as follows:

1. A system for controlling the location of the nucleate boiling region in a fluid heated steam generator comprising:

means for measuring the temperature gradient of the heating fluid at a plurality of locations along the steam generator;

means for determining a control variable, $Q_w$, in accordance with a predetermined relationship, said relationship being a function of said measured temperature gradients, and for generating a control signal in response thereto; and means for adjusting the feedwater flow rate into the steam generator, in accordance with said control signal.

2. The system of claim 1 wherein the fluid is liquid sodium and the steam generator is of the once-through type.

3. The system of claim 2 wherein said temperature gradient measuring means comprises at least first through fourth temperature sensors positioned at first through fourth locations having measured temperatures of $T_1$, $T_2$, $T_3$, $T_4$ respectively.

4. The system of claim 3 wherein said predetermined relationship is:

$$Q_w=Q_s\{K_1+K_2[(T_4-T_3)/(T_2-T_1)-K_3]\}$$

where $Q_s$ is the measured steam flow out of the steam generator and $K_1$, $K_2$, $K_3$ are constants.

5. The system of claim 4 wherein said first sensor is positioned in the subcooled region of the steam generator, said second and third sensors are positioned near the lower and upper interfaces, respectively, of the nucleate boiling region of the steam generator, and said fourth sensor is positioned in the film boiling region of the steam generator.

6. A method for controlling the location of the nucleate boiling region in a fluid heated steam generator comprising the steps of:

measuring the temperature gradient of the heating fluid at a plurality of locations along the steam generator;

determining a control variable, $Q_w$, in accordance with a predetermined relationship, said relationship being a function of said measured temperature gradients, and generating a control signal in response thereto; and adjusting the feedwater flow rate into the steam generator, in accordance with said control signal.

7. The method of claim 6 wherein the fluid is liquid sodium and the steam generator is of the once-through type.

8. The method of claim 7 wherein said temperature gradient measuring step includes: positioning at least first through fourth temperature sensors at first through fourth locations having measured temperatures of $T_1$, $T_2$, $T_3$, $T_4$ respectively.

9. The method of claim 8 wherein said predetermined relationship is:

$$Q_w=Q_s\{K_1+K_2[(T_4-T_3)/(T_2-T_1)-K_3]\}$$

where $Q_s$ is the measured steam flow out of the steam generator and $K_1$, $K_2$, $K_3$ are constants.

10. The method of claim 9 wherein said first sensor is positioned in the subcooled region of the steam generator, said second and third sensors are positioned near the lower and upper interfaces, respectively, of the nucleate boiling region of the steam generator, and said fourth sensor is positioned in the film boiling region of the steam generator.

* * * * *